United States Patent [19]

Moyer

[11] 4,029,954

[45] June 14, 1977

[54] PORTABLE LAMP

[75] Inventor: John N. Moyer, Penns Park, Pa.

[73] Assignee: HMS Associates, Inc., Willow Grove, Pa.

[22] Filed: Nov. 10, 1975

[21] Appl. No.: 630,233

[52] U.S. Cl. ..... 240/10.6 CH; 240/10.63; 320/2; 339/8 R

[51] Int. Cl.[2] ..... F21L 7/00

[58] Field of Search ..... 240/10.6 CH, 10.63, 240/11.2 R, 52 R, 52.1; 339/8 R, 156 R; 320/2

[56] References Cited

UNITED STATES PATENTS

| | | | |
|---|---|---|---|
| 3,275,919 | 9/1966 | Decker et al. | 320/2 |
| 3,517,185 | 6/1970 | Moore et al. | 240/10.63 |
| 3,591,796 | 7/1971 | Barker | 240/10.6 CH |
| 3,829,676 | 8/1974 | Nelson | 240/10.6 CH |
| 3,835,309 | 9/1974 | Witte et al. | 240/10.6 CH |

*Primary Examiner*—R. L. Moses
*Attorney, Agent, or Firm*—Seidel, Gonda & Goldhammer

[57] ABSTRACT

A portable lamp comprises a lamp enclosure and a base. A lamp and one or more batteries are located within the lamp enclosure. When the lamp enclosure is removed from the base, the lamp is energized. When the lamp enclosure is mounted on the base, the lamp is de-energized and the batteries are recharged. The lamp enclosure can be mounted on the base without any interlocking mechanical connections and at any angular orientation about an axis transverse to the base.

15 Claims, 6 Drawing Figures

FIG. 1
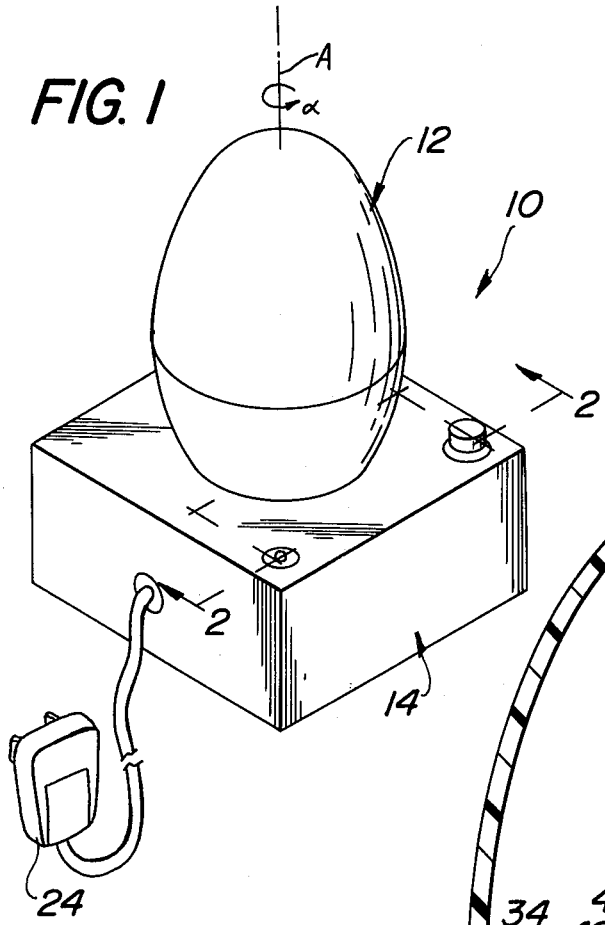
FIG. 4
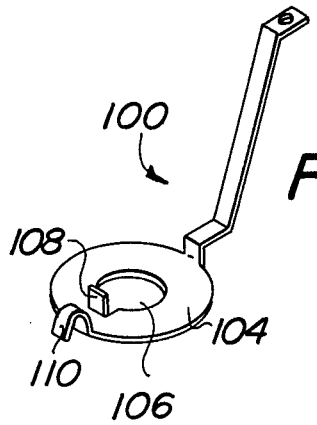
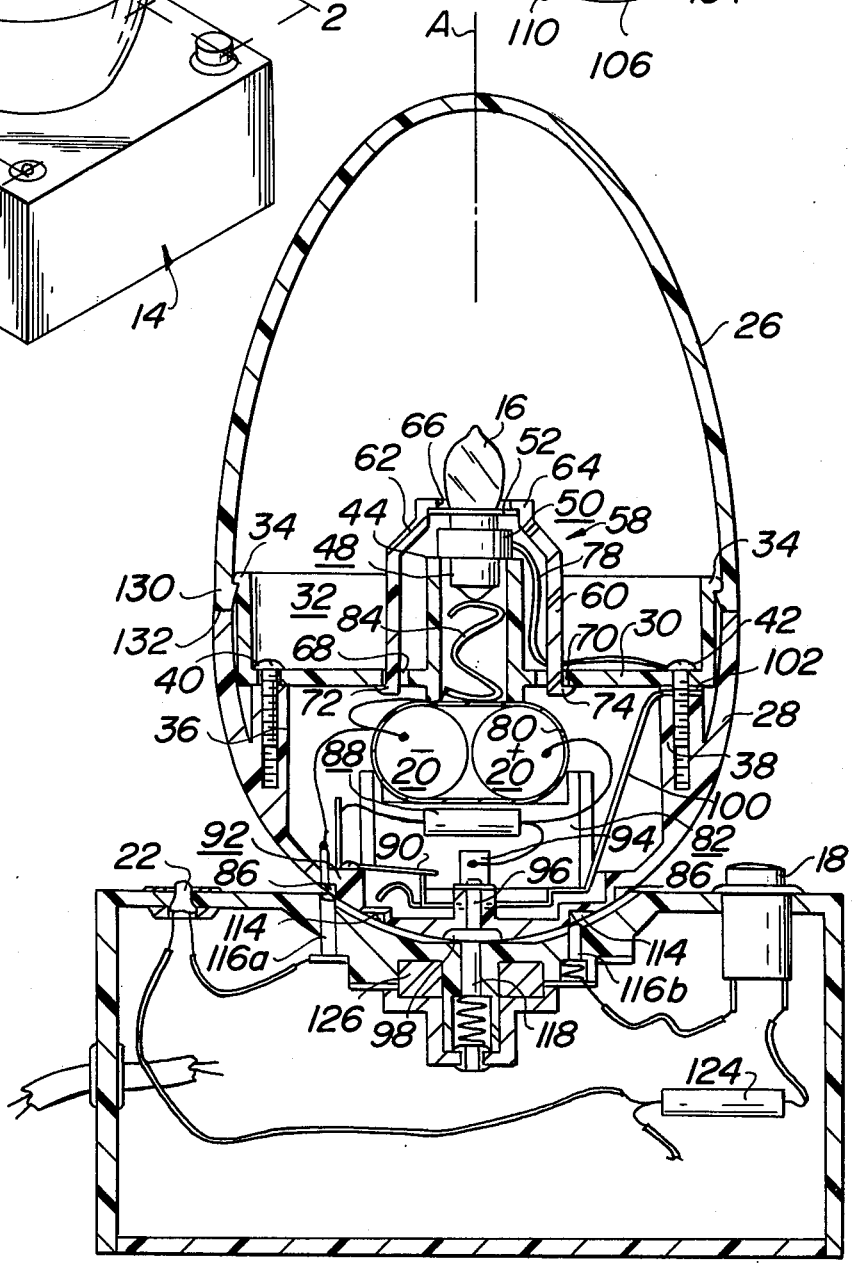
FIG. 2

FIG. 3
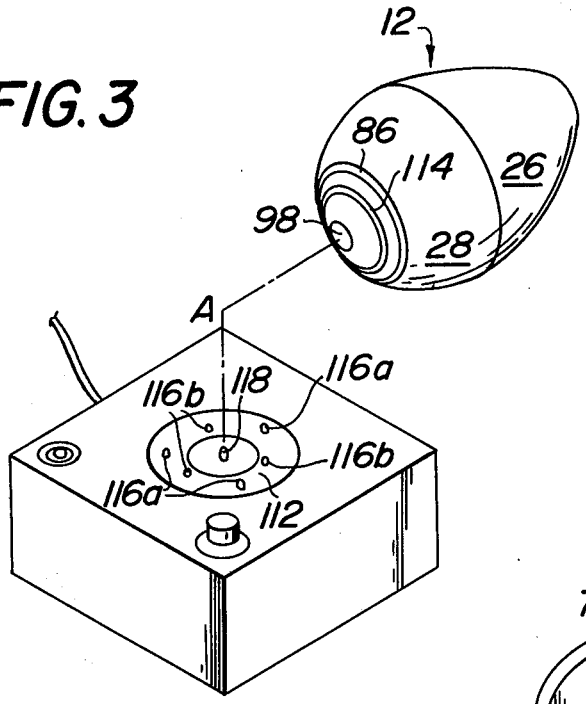
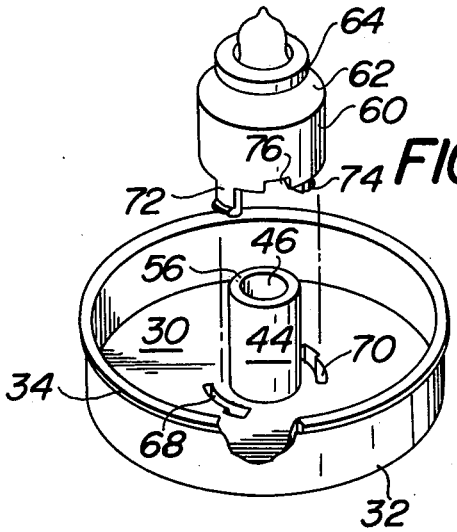
FIG. 5
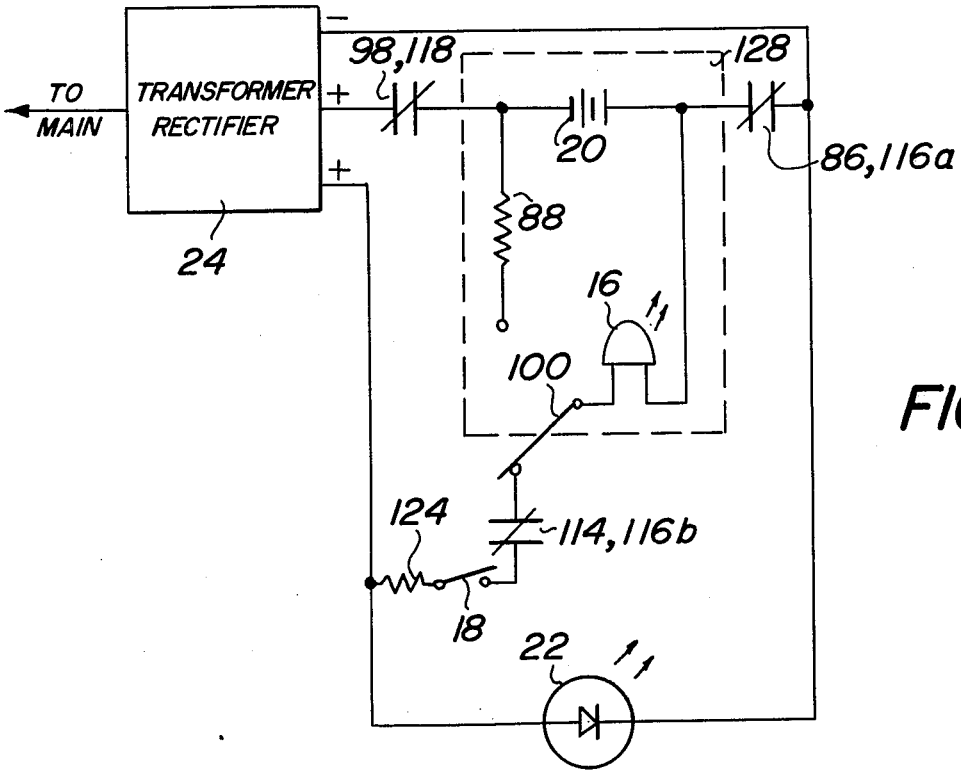
FIG. 6

PORTABLE LAMP

BACKGROUND OF THE INVENTION

The present invention relates to a portable battery operated lamp. More particularly, the present invention relates to a portable lamp having means for automatically energizing the lamp and for recharging the batteries without the need for special interlocking mechanical fittings and regardless of the angular orientation of the lamp about a fixed axis.

It is known in the art to energize a portable lamp by means of one or more batteries and to automatically de-energize the lamp when it is placed on a base at a specific angular orientation about an axis perpendicular to the base. Usually, the lamp is removably secured to the base by means of interlocking mechanical components. For example, the lamp and the base are specially fitted so that a mechanical switch can be actuated upon the interconnection of the lamp and base.

It is also known that batteries used for driving emergency lamps and the like may be recharged by means of a transformer /rectifier circuit,

BRIEF SUMMARY OF THE INVENTION

Briefly, the present invention comprises a lamp enclosure; a base for supporting the lamp enclosure; a lamp and one or more batteries located within the lamp enclosure; means for energizing the lamp when the lamp enclosure is removed from the base; and means for de-energizing the lamp and recharging the batteries when the lamp enclosure is mounted on the base at any angular orientation about an axis transverse to the base. Means are also provided for energizing the lamp while said batteries are recharging.

A primary advantage of the present invention is that the lamp can be automatically de-energized and the batteries recharged without regard to the orientation of the lamp about an axis perpendicular to the base.

A further advantage of the present invention is the elimination of the mechanical interconnection of the lamp and base and the use of any special fittings therebetween.

Another advantage of the present invention is that the means for energizing and de-energizing the lamp is wholly contained within the lamp enclosure and the base.

A further advantage of the present invention is that the operation thereof is fully automatic without the need for any manual adjustment of external parts by the operator.

Other advantages of the invention are set forth in the detailed description herein below.

For the purpose of illustrating the invention, there is shown in the drawings a form which is presently preferred; it being understood, however, that this invention is not limited to the precise arrangements and instrumentalities shown.

BRIEF DESCRIPTION OF THE DRAWINGS

FIG. 1 is a perspective view of the portable lamp constructed in accordance with the purposes of the present invention.

FIG. 2 is a cross-sectional view taken along the lines 2—2 in FIG. 1.

FIG. 3 is an exploded perspective view of the lamp enclosure and base for the portable lamp shown in FIG. 1.

FIG. 4 is a perspective view of the magnetically actuated switch shown in FIG. 2.

FIG. 5 is an exploded perspective view of the internal structure of the lamp enclosure for housing the lamp.

FIG. 6 is an electrical schematic showing the interconnection of the batteries, lamp and switches in the present invention.

DETAILED DESCRIPTION OF THE INVENTION

Referring to the drawings wherein like numerals indicate like elements, there is shown in FIG. 1 a portable lamp constructed in accordance with the principles of the present invention and designated generally as 10. The portable lamp comprises a lamp enclosure 12 and a base 14. A transformer/rectifier 24 is electrically connected to circuit components located in base 14. The interconnection of transformer/rectifier 24 and the circuit components located within base 14 is shown in greater detail in FIG. 6 and is described more fully below.

Lamp enclosure 12 is provided with a lamp 16 and batteries 20, FIG. 2. A push button switch 18 is located on base 14. When lamp enclosure 12 rests on base 14, lamp 16 will not light unless push button switch 18 is depressed. In addition, when lamp enclosure 12 rests on base 14, transformer/rectifier 24 recharges batteries 20.

A light-emitting diode 22 located on base 14 indicates that transformer/rectifier 24 is connected to the main and that voltage is being supplied by the transformer/rectifier.

In the preferred embodiment described herein, lamp enclosure 14 is an ovoid comprising a semi-transparent cap 26 and an opaque bottom enclosure 28, FIG. 2. Cap 26 is provided with a plurality of lugs 130 along circular edge 132. Bottom enclosure 28 is provided with a circular shelf 30 connected to a cylindrical wall 32 which is provided with a lip 34 along its upper edge. Lip 34 engages lugs 130 to prevent cap 26 from inadvertently loosening with respect to bottom enclosure 28. Shelf 30 is supported by studs 36 and 38 in bottom enclosure 28. Shelf 30 is removably attached to studs 36 and 38 by means of screws 40 and 42, respectively.

Shelf 30 is also provided with a cylindrical pedestal 44 having an opening 46, see FIGS. 2 and 5, in which the metal casing 48 of lamp 16 depends. A ring clamp 50 is secured to metal casing 48 immediately beneath flanged portion 52 of casing 48, FIG. 2. When lamp 16 is inserted in pedestal 44, clamp 50 rests on the upper annular edge 56 of the pedestal, FIGS. 2 and 5, and lamp casing 48 depends in opening 46.

Lamp 16 is held in place by means of housing 58, see FIG. 2. Housing 58 holds down the flanged portion 52 of casing 48. Housing 58 comprises a cylindrical wall 60, a frustrum-shaped wall 62 and an annular shoulder 64 having a circular lip 66. Lip 66 holds down flanged portion 52 of lamp 16 so that the lamp is held firmly in place on pedestal 44, FIG. 2.

Housing 58 is removably attached to shelf 30 by means of slots 68 and 70 in shelf 30 and flanged legs 72 and 74 of housing 58. The legs 72 and 74 and slots 68 and 70 form a bayonet-type locking mechanism. The legs 72 and 74 are inserted in the slots 68 and 70 and the housing is rotated to lock the legs in the slots. A portion of the wall 60 of housing 58 is cut away along the bottom edge of the wall to form a passage 76, FIG. 5, through which wire 78, FIG. 2, attached to clamp 50, can pass.

The pair of rechargeable batteries 20 is located within a battery casing 80 supported on a ring-like member 82 in bottom enclosure 28. The negative side of one of the batteries is connected to a resilient contact 84 which is pushed upwardly by the battery casing 80 into contact with the lamp 16. The negative side of the same battery is also connected to a ring contact 86 which is symmetrically mounted in bottom enclosure 28 with respect to the vertical axis A, FIG. 2. Contact 86 is exposed along the bottom surface of enclosure 28. The positive side of the other battery in casing 80 is connected to a resistor 88 which in turn is connected to cantilevered contact 90 mounted on circular shoulder 92 in bottom enclosure 28. The positive side of the same battery is also connected to contact 94 which is electrically connected by means of post 96 to circular contact 98, FIGS. 2 and 3. Circularcontact 98 is symmetrically mounted within bottom enclosure 28 with respect to axis A and is exposed along the bottom surface of the enclosure.

A magnetically actuated spring contact 100 is connected by means of wire 78 and washer 102 to lamp 16. Referring to FIG. 4, spring contact 100 is provided with a flat circular member 104 having an opening 106, a vertically extending tab 108 and a hooked contact 110. In the operated condition, lamp enclosure 12 being removed from base 14, tab 108 of spring contact 100 makes electrical connection with cantilevered contact 90. Accordingly, current flows in battery loop 128, FIG. 6, from the batteries 20 through resistor 88, cantilevered contact 90, spring contact 100, and lamp 16. Thus, the lamp enclosure 12 may be carried in the hand away from base 14 while lamp 16 provides light.

The invention may also be used as a stationary lamp and the batteries 20 recharged by seating lamp enclosure 12 within depression 112 of base 14. Lamp 16 can be turned on and off by switch 18. The lamp enclosure 12 can be placed on base 14 at any angular orientation with respect to the axis A to recharge batteries 20 and permit operation as a stationary lamp.

As shown in FIG. 3, bottom enclosure 28 is provided with a set of three concentric contacts, circular contact 98, ring contact 114 and ring contact 86, which are symmetrically arranged with respect to the axis A. Preferably, circular contact 98 is centered on the axis A. Ring contact 86 encloses ring contact 114 which encloses circular contact 98. Both ring contacts 86 and 114, and circular contact 98, are exposed along the bottom surface of enclosure 28.

When the invention is used as a stationary lamp, bottom enclosure 28 nests snugly within depression 112 in base 14. Depression 112 is shaped to receive a portion of the bottom surface of enclosure 28 and to retain lamp enclosure 21 in position without any interlocking mechanical parts or other special fittings. Depression 112 is provided with a plurality of depressable contacts **116*a* and 116*b* arranged in circular patterns to make electrical connection with ring contacts 86 and 114, respectively. The depression is also provided with a central contact 118 which is positioned to make electrical connection with circular contact 98. Contacts 116*a* are connected to transformer/rectifier 24 and light-emitting diode 22. Contacts 116*b* are connected through push button switch 18 and resistor 124 to transformer/rectifier 24. Transformer/rectifier 24 is a conventional unit such as the Model No. 10039 transformer/rectifier manufactured by Rowe Industries, Inc. Central contact 118 is a depressable contact connected to transformer/rectifier 24. A ring magnet 126 is positioned immediately underneath depression 112 in base 14. Ring magnet 126 actuates spring contact 100 so that hooked contact 110 makes connection with ring contact 114 when lamp enclosure 12 is placed within depression 112. Ring magnet 126 actuates spring contact 100, contacts 116*a* and 116*b* make electrical connection with ring contacts 86 and 114, and contact 118 makes electrical connection with contact 98, regardless of the angular orientation of a lamp enclosure 12 with respect to axis A, FIG. 1, and without any interlocking connection between enclosure 12 and base 14.**

When lamp enclosure 12 rests within depression 12 with switch 18 open, lamp 16 automatically goes off and the batteries 20 start to recharge. Thus, ring contact 86 makes electrical connection with depressable contacts **116*a*, ring contact 114 makes electrical connection with depressable contacts 116*b*, circulated contact 98 makes electrical connection with central contact 118 and magnet 126 causes spring contact 100 to move downwardly so that hooked contact 110 make electrical connection with ring contact 114 and tab 108 breaks electrical connection with cantilevered contact 90. Accordingly, current flows from transformer/rectifier 24 through central contact 118 and circular contact 98 to batteries 20, ring contact 86 and depressable contacts 116*a*. Since spring contact 100 is displaced by magnet 126 so that tab 108 breaks electrical connection with contact 90, current cannot flow through contacts 118 and 98 to lamp 16. And if switch 18 is open, current cannot flow through resistor 124** to the lamp.

If it is desired to operate the invention as a stationary lamp as batteries 20 recharge, lamp 16 can be turned on by means of switch 18. One side of switch 18 is connected through resistor 124 to transformer/rectifier 24. The other side of switch 18 is connected through ring contact 114, depressable contacts **116*b*, spring contact 100, lamp 16 and ring contact 86 and depressable contacts 116*a* to transformer/rectifier 24. If switch 18 is closed when lamp enclosure 12 is placed on base 14, lamp 16 will be turned on. Thus, while batteries 20 are recharging with lamp enclosure 12 on base 14, lamp 16 may be turned on by operating switch 18.**

Referring to FIG. 6, there is shown an electrical schematic of the present invention. The connection of contacts 86, 114 and 98 and contacts **116*a*, 116*b* and 118 are represented by conventional symbols for electrical switches with normally closed positions corresponding to conditions when lamp enclosure 12 is resting on base 14. Spring contact 100 is represented as a two position switch. When lamp enclosure 12 is removed from base 14, that is, when the invention is used as a portable lamp, current flows through internal battery loop 128 comprising batteries 20, resistor 88, spring contact 100 and lamp 16. Lamp 16, therefore, will remain on as long as lamp enclosure 12 is removed from base 14.**

Normally, switch 18 on base 14 will be open. When lamp enclosure 12 is placed within depression 112 with switch 18 open, lamp 16 automatically turns off and the batteries 20 recharge. Thus, spring contact 100 opens battery loop 128 and lamp 16 turns off. At the same time, batteries 20 automatically recharge since current flows from transformer/rectifier 24 through contacts 98 and 118, batteries 20 and contacts 86 and **116*a*. If, however, it is desired to operate the invention as a stationary lamp, lamp 16 may be turned on while batteries 20 are recharging by closing switch 18. When switch 18 is closed current flows through resistor 124, switch 18, contacts 114 and 116***b*, spring contact 100 and lamp 16.

The light-emitting diode 22 is connected to transformer/rectifier 24. If transformer/rectifier 24 is energized by the main and is providing voltage at its outputs, light-emitting diode 22 will so indicate. Diode 22 can also serve as a convenient means for locating the portable lamp 10 in the dark.

It wil be noted that there are no interlocking mechanical parts between lamp enclosure 12 and base 14 so that the lamp enclosure can be easily removed from the base. In addition, due to the symmetrical arrangement of the ring contacts in lamp enclosure 12 and the depressable contacts in depression 112 of base 14, the lamp enclosure can be oriented in any angular position $\alpha$ with respect to axis A to effectuate operation of the invention as previously described. Moreover, since the spring contact 100 and magnet 126 are disposed inside lamp enclosure 12 and base 14, respectively, there are no external mechanical components in the invention which require manual adjustment. Portable operation of the lamp 16 and automatic recharging of the batteries 20 are effected merely by moving lamp enclosure 12 in and out of depression 112.

If desired, the depressable contacts, 116*a*, 116*b* and 118 may be beveled at their tips to provide a wider area of contact with ring contacts 86 and 114 and circular contact 98.

Although the angular orientation $\alpha$ of lamp enclosure 12 on base 14 has been described in respect to a vertical axis A it should be understood that the invention is directed more generally to a lamp enclosure which may be mounted on a base without regard to the angular orientation of the lamp enclosure about an axis transverse to the base. In the preferred embodiment described herein the axis is vertical. The axis may, however, be horizontal if the base itself is mounted in a vertical plane such as a wall.

The present invention may be embodied in other specific forms without departing from the spriit or essential attributes thereof and, accordingly, reference should be made to the appended claims, rather than to the foregoing specification as indicating the scope of the invention.

I claim:

1. A portable lamp, comprising:

a lamp enclosure;

a base for supporting said lamp enclosure, said base including a plug connectable to a power source;

a lamp and one or more batteries connected thereto within said lamp enclosure;

means for recharging said batteries when said lamp enclosure is mounted on said base at an angular orientation about an axis transverse to said base; and means for automatically energizing said lamp when said lamp enclosure is removed from said base independently of the connection of a power source to said plug.

2. The portable lamp according to claim 1 wherein said means for recharging said batteries includes a first contact mounted on said lamp enclosure, a first depressable contact mounted on said base along said axis for making electrical connection with said first lamp enclosure contact when said lamp enclosure is mounted on said base, an annular contact mounted on said lamp enclosure, said first lamp enclosure contact and said annular lamp enclosure contact being concentric, and one or more depressable contacts mounted on said base in a circular pattern concentric with said first base contact for making electrical connection with said annular lamp enclosure contact when said lamp enclosure is mounted on said base.

3. The portable lamp according to claim 1 wherein said means for automatically energizing said lamp includes an annular contact mounted on said lamp enclosure, a magnetically actuated switch mounted in said lamp enclosure, one or more depressable contacts mounted on said base in a circular pattern about said axis, and a magnet mounted in said base for actuating said switch.

4. The portable lamp according to claim 3 including means for energizing said lamp when said lamp enclosure is mounted on said base.

5. The portable lamp according to claim 1 including means for indicating that said recharging means and said energizing means are supplied with voltage.

6. The portable lamp according to claim 5 wherein said indicating means is a light-emitting diode.

7. The portable lamp according to claim 1 wherein said lamp enclosure is ovoid shaped and said base is provided with a depression for receiving said lamp enclosure.

8. A portable lamp, comprising:

a lamp enclosure;

a base for supporting said lamp enclosure;

a lamp located within said lamp enclosure;

means for energizing said lamp when said lamp enclosure is removed from said base; and means for de-energizing said lamp and for reenergizing said energizing means when said lamp enclosure is mounted on said base regardless of the angular orientation of said lamp enclosure about an axis transverse to said base.

9. The portable lamp according to claim 8 wherein said means for de-energizing said lamp includes a magnetically actuated switch mounted in said lamp enclosure and a magnet mounted in said base.

10. The portable lamp according to claim 8 including means for energizing said lamp when said lamp enclosure is mounted on said base.

11. The portable lamp according to claim 8 wherein said means for re-energizing said energizing means includes one or more contacts concentrically mounted on said lamp enclosure and one or more depressable contacts mounted on said base for making electrical connection with said lamp enclosure contacts when said lamp enclosure is mounted on said base.

12. A portable lamp, comprising:

a lamp enclosure;

a base for supporting said lamp enclosure without mechanically interlocking said lamp enclosure and base;

means for energizing said lamp when said lamp enclosure is removed from said base; and means for de-energizing said lamp and for reenergizing said energizing means when said lamp enclosure is supported by said base regardless of the angular orientation of said lamp enclosure about an axis transverse to said base.

13. The portable lamp according to claim 12 wherein said means for de-energizing includes a magnetically actuated switch mounted in said lamp enclosure and a magnet mounted in said base.

14. The portable lamp according to claim 12 including means for energizing said lamp when said lamp enclosure is supported by said base.

15. A portable lamp, comprising:

a lamp enclosure;

a lamp and one or more batteries connected thereto within said lamp enclosure;

a base for supporting said lamp enclosure;

one or more lamp enclosure contacts mounted symmetrically on said lamp enclosure;

one or more base contacts mounted symmetrically on said base for making electrical connection with said lamp enclosure contacts when said lamp enclosure is mounted on said base at any angular orientation about an axis transverse to said base;

an externally actuated switch mounted in said lamp enclosure for selectively connecting said batteries to said lamp;

means mounted in said base for causing said switch to connect said batteries to said lamp when said lamp enclosure is removed from said base; and means connected to said base contacts for recharging said batteries when said lamp enclosure is mounted on said base.

* * * * *